United States Patent [19]

Terenzoni

[11] Patent Number: 4,980,999

[45] Date of Patent: Jan. 1, 1991

[54] SYSTEM FOR RAISING A ROOF

[76] Inventor: Robert S. Terenzoni, 98 Boston Ave., Medford, Mass. 02155

[21] Appl. No.: 224,744

[22] Filed: Jul. 27, 1988

[51] Int. Cl.[5] ..... E02D 35/00

[52] U.S. Cl. ..... 52/125.6; 52/745

[58] Field of Search ..... 52/741, 745, 125.1, 52/125.6

[56] References Cited

U.S. PATENT DOCUMENTS

| | | | |
|---|---|---|---|
| 2,222,037 | 11/1940 | Lafferty | 52/745 |
| 3,921,362 | 11/1975 | Cortina | 52/745 |
| 4,058,952 | 11/1977 | Donnelly | 52/125.1 |
| 4,197,689 | 4/1980 | DeMuth | 52/745 |
| 4,467,585 | 8/1984 | Busby | 52/741 X |
| 4,782,634 | 11/1988 | Fry | 52/125.1 |

*Primary Examiner*—Richard E. Chilcot, Jr.
*Assistant Examiner*—Lan Mai
*Attorney, Agent, or Firm*—Joseph S. Iandiorio; Brian M. Dingman

[57] ABSTRACT

Apparatus and method for raising a roof including at least two lifting beams which are generally parallel to the peak or highest point of the roof and at least two pairs of lifting towers which are arranged about the building. Each pair of lifting towers has one tower disposed along one face of the building and the other tower disposed along the opposite face of the building. The lifting beams are interconnected with the roof portion and the lifting towers; the selected roof portion is then severed from the building and lifting means raises the lifting beams and the attached selected portion of the roof. After installing walls under the raised portion of the roof, the roof is lowered and attached to the newly constructed walls to form the additional expanded space of the building.

14 Claims, 7 Drawing Sheets

SYSTEM FOR RAISING A ROOF

FIELD OF INVENTION

This invention relates to apparatus and a method for severing and raising at least a selected portion of an existing roof to expand the interior space of a building.

BACKGROUND OF INVENTION

The rising cost of homes and the ever-decreasing supply of building lots has sparked a marked increase in the remodeling of existing homes. Remodeling to expand the existing structure and gain additional space is often less expensive and easier than selling an existing home and buying a new one. Given the small size of many center city and suburban building lots, expansion may only proceed in one direction: upwards.

Constructing another level to the existing building is generally accomplished by removing and discarding the existing roof, and building new walls, floor, and roof over the existing building. Alternatively, a roof may be severed from the building and a crane brought in to remove the roof while the building is enlarged. The roof is later reinstalled and reattached on top of the new structure.

The feasibility of using a crane, however, is limited to larger yards which will accommodate the larger cranes needed to lift the weight of a roof. Many roofs, in fact, may be too heavy for even a large crane to lift. Even if the roof can be lifted by the crane, the yard must be large enough to enable the crane to get near the building as well as for the crane operator to set down the roof section, once severed from the existing building, while the new structure is being built. An added concern is that the existing structure can be damaged by adverse weather conditions occurring while the roof is removed. Further, severe damage to the building owner's yard and landscaping is often caused by the large crane itself, as well as the roof stored in the yard.

SUMMARY OF INVENTION

It is therefore an object of this invention to provide an improved method and apparatus for raising at least a selected portion of an existing roof of any length and shape.

It is a further object of this invention to provide such a method and apparatus which can be used regardless of the size of the yard.

It is a further object of this of this invention to provide a method for raising a roof which does not require major alterations to the roof and which saves the entire roof structure as well as attachments.

It is a still further object of this invention to provide an apparatus for raising a roof which is reusable and can be carried by hand to the building site and arranged around any building configuration on virtually any terrain.

It is a further object of this invention to provide an improved method and apparatus for raising a roof which allows the roof to be raised and lowered to other than a final position, thereby eliminating the requirement that work be completed all in one day to prevent possible weather interference and damage.

This invention results from the realization that a truly effective system for raising a roof, capable of being installed around a building having a varied layout and situated on uneven terrain, can be achieved by providing a portable, modular apparatus having at least two pairs of lifting towers which are arranged around a building and connected with at least two lifting beams placed generally parallel to a peak of the existing roof, and whereby a selected roof portion may be severed from the existing building and raised, allowing additional space to be constructed underneath it without waste of building materials or concern for building and yard damage.

This invention features a method and apparatus for raising a selected portion of a roof. The method includes installing at least two lifting beams under the roof and in generally parallel relationship to one another. At least two pairs of lifting towers are arranged about the building, each pair having one tower disposed along one face of the building and the other tower disposed along the opposite face of the building. The lifting beams are then interconnected with the roof portion and the lifting towers. The selected roof portion is then severed from the existing building and lifting force is applied to raise the lifting beams and the attached severed roof portion. New walls are installed under the raised roof portion or on the ground and lifted into position, and the roof is subsequently attached to the newly constructed walls to form the additional expanded space of the building.

In one embodiment, the lifting beams may be expandable in length to at least reach two exterior outermost points of the selected roof portion. Additionally, a selected roof portion may be raised to other than a final position.

In an additional embodiment, the method includes installing a plurality of cross-support members under the roof which extend to opposite interior surfaces of the roof. The lifting beams are then interconnected with the cross-support members. Additionally, cross-lifting beams may be installed perpendicular to the lifting beams. In such cases, the cross-lifting beams and the lifting beams are interconnected by means such as cables. Additionally, the cross-lifting beams may be expandable in length or two or more beams used together to reach at least the exterior surfaces of the selected roof portion and may be interconnected with the lifting towers.

This invention also features an apparatus for raising at least a portion of a roof. The apparatus includes lifting beams engaged with the roof portion to be raised. Lifting towers are provided, including two columns spaced apart and generally parallel and coupling means engaged with the two columns which ride up and down along the columns and engage with the lifting beams. Lifting means raise and lower the lifting beams and the attached selected portion of the roof.

In one embodiment, the lifting towers include adjustable support bases for adjusting to unlevel ground to keep the columns generally vertical. The lifting towers may also include stabilizer means to increase the stability of the lifting towers.

The lifting means may be provided by a hoist or winch and cable. Alternatively, the lifting means may be provided by at least one pneumatic or hydraulic cylinder. The two columns of the lifting towers may be solid tubular forms or may be perforated with holes which align on opposite faces.

DISCLOSURE OF PREFERRED EMBODIMENT

Other objects, features, and advantages will occur from the following description of a preferred embodiment and the accompanying drawings, in which.

Figure 1:
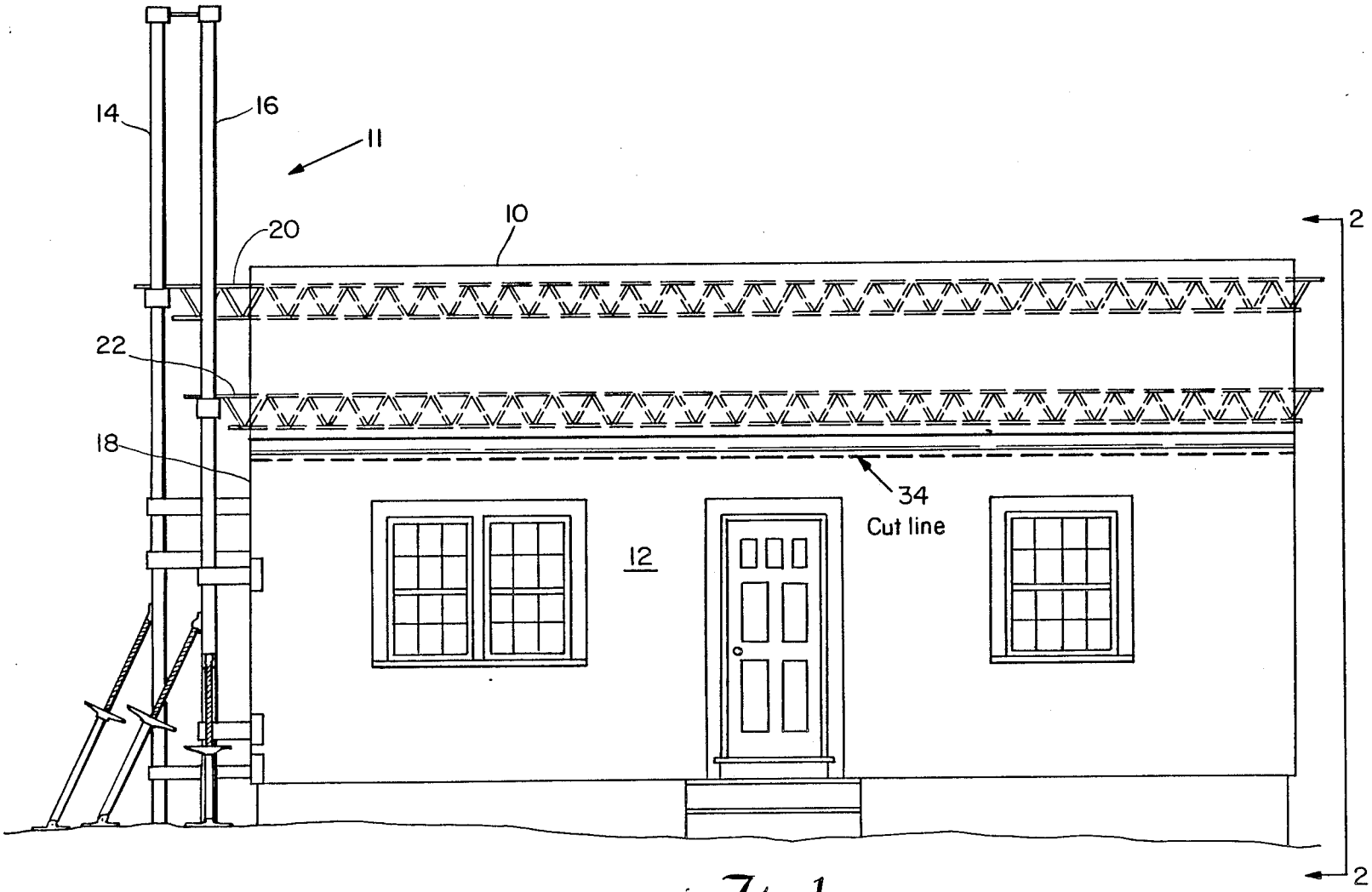
FIG. 1 is a front view of a building with an existing roof to be raised using a system according to this invention.

A system for raising a roof according to this invention may be accomplished by providing a modular, portable apparatus which can be carried by hand and arranged around an existing building having a varied layout and uneven terrain. A selected portion of a roof is severed from the existing building and raised, while additional space is constructed underneath, after which the severed roof portion is attached to the walls to complete the newly expanded building.

The modular portable apparatus consists of lifting towers and lifting beams. The lifting towers are comprised of two columns spaced apart and generally parallel. Each column may be provided as a closed tubular form having a round, square, or rectangular shape. The column may have a slot or opening for engaging with a lifting coupling. In one construction, the exterior faces of the column are perforated with holes, pairs of which align on opposite faces of the column to facilitate placement of a safety pin to ensure that the lifting coupling will not drop down the column, as well as to secure other stabilizing couplings that may be used.

A lifting coupling is provided which engages with each of the columns and rides up and down along them. The coupling may completely or partially surround each column or may engage with a groove or slot in the columns. The lifting coupling serves to guide the roof as it is raised and lowered.

The base of the column includes a supporting base which is adjustable in height over a range of several inches to conform to variations in terrain from one column to another. Lifting towers also include adjustable stabilizer braces which attach to the columns and may attach to the house wall or the ground at a point at least several feet from the ground and extend outwardly away from the columns to form a triangular base which serves to stabilize the towers and keep them in a generally vertical position. The columns are interconnected by cross pieces at various points along their vertical span to keep the columns a uniform distance apart and in fixed relationship to one another.

In one construction, lifting means is provided by a pneumatic or hydraulic cylinder which directly, or indirectly via a cable, provides lifting force to the lifting beams. In another construction, lifting means may be provided by a winch or hoist and cable system which may be located within the lifting towers or externally of the towers.

Lifting beams are provided which connect the roof portion to be raised with the lifting coupling of the lifting towers. The lifting beams are relatively lightweight and portable and may be a solid or hollow tubular form. Alternatively, a truss framed beam may be used. Additionally, the beam may be expandable and collapsible in length to adjust to any size roof.

The method of raising a roof according to this invention includes installing at least two lifting beams generally parallel to one another and under the selected portion of the roof to be raised. There may also be a lifting beam installed at or near a peak of the roof. If not already present in some form, several cross-members which span the width of the roof and are attached to the roof rafters on opposite interior surfaces of the roof are installed to hold the roof surfaces in a fixed position relative to one another.

In an alternative embodiment, installing the lifting beams may also include installing one or more cross-lifting beams, perpendicular to the lifting beams. The cross-lifting beams may be placed under or over the lifting beams and are connected to the lifting beams by a cable or other fastener. Alternatively, the cross-lifting beams are disposed above the roof and connected to the lifting beams by cable means.

At least two pairs of lifting towers are arranged about the building, each pair having one tower disposed along one face of the building and the other tower disposed along the opposite face of the building. The lifting and/or cross-lifting beams are then engaged to the lifting couplings on the lifting towers.

A selected portion of the roof is then severed from the building. The gable ends are cut, and the roof rafters are separated from the existing ceiling joists. Any attachments to the roof, such as gutters, may remain in place and are not affected. The roof is then able to be raised, and preparation of the additional space begins.

The roof may be raised and lowered any number of times to any desired height so as to enable construction to proceed at a reasonable pace. If necessary, the roof may be lowered at night to protect the existing building, and in any case, is always maintained over the building to provide protection from the elements. Once walls are constructed, the roof is then attached to the newly constructed space.

Roof raising apparatus 11, FIG. 1, according to this invention is adapted to raise roof portion 10 of house 12. Lifting towers 14 and 16 are arranged along exterior wall 18 of house 12. Lifting beams 20 and 22 are installed under and parallel to the longitudinal axis of roof portion 10.

Figure 2:
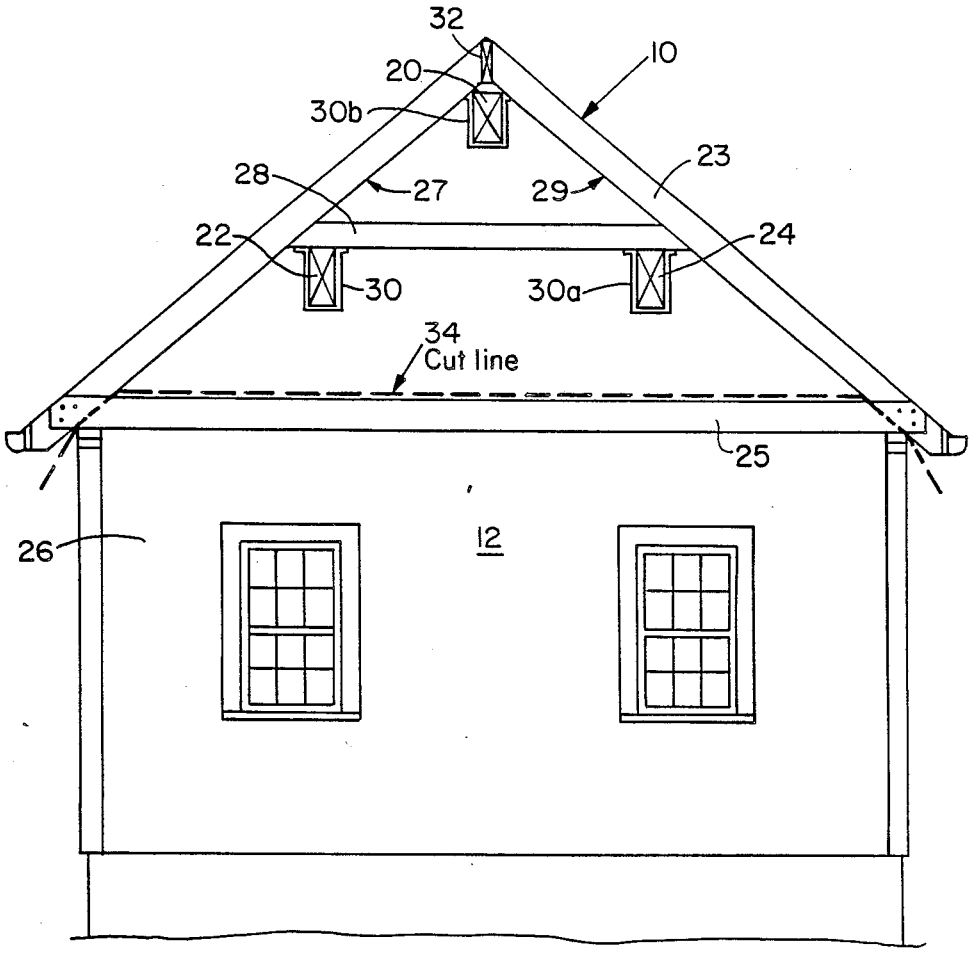
FIG. 2 is an end view of the building of FIG. 1.

In preparation for lifting roof portion 10 of house 12, opposite exterior wall 26, FIG. 2, is shown with lifting beams 20, 22, and 24 in place. Lifting beams 22 and 24 are placed adjacent to cross-member 28 and are held in place by retaining brackets or cables 30 and **30*a*. Cross-member 28 may already be present under roof portion 10 prior to raising the roof or in another construction may be installed by attaching one end of cross-support member 28 to interior surface 27 of roof 10 and attaching the other end to opposite interior surface 29 to maintain the interior surfaces of the roof in fixed relationship to one another. Lifting beam 20 is placed directly underneath and adjacent to peak 32 of roof portion 10, and is held in place by retaining bracket or cable 30*b*. A cut is then made along line 34 before roof portion 10** is lifted.

In addition, roof rafters 23 are disconnected or severed from ceiling joist 25.

Figure 3:
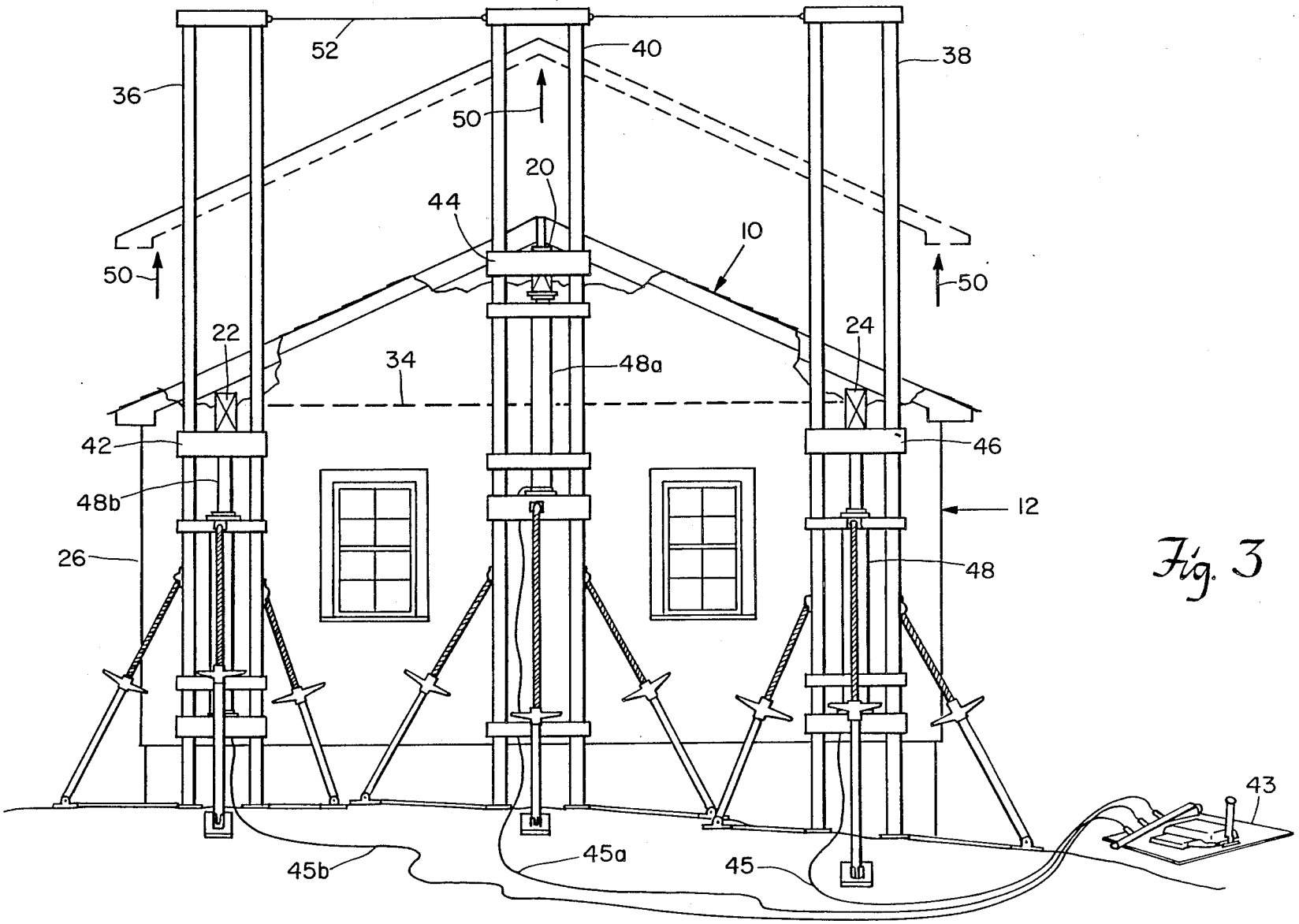
FIG. 3 is an end view of the building of FIG. 2 with the lifting apparatus in place according to this invention.

Towers 36, 38, and 40, FIG. 3, are then installed along exterior wall 26, opposite from the lifting towers installed along opposite exterior wall 18, FIG. 1. Lifting couplings 42, 44, and 46 engage lifting beams 20, 22, and 24. Cable 52 connects the upper portions of lifting towers 36, 38, and 40 to keep them in spaced relationship to one another, preventing them from spreading apart.

Figure 4:
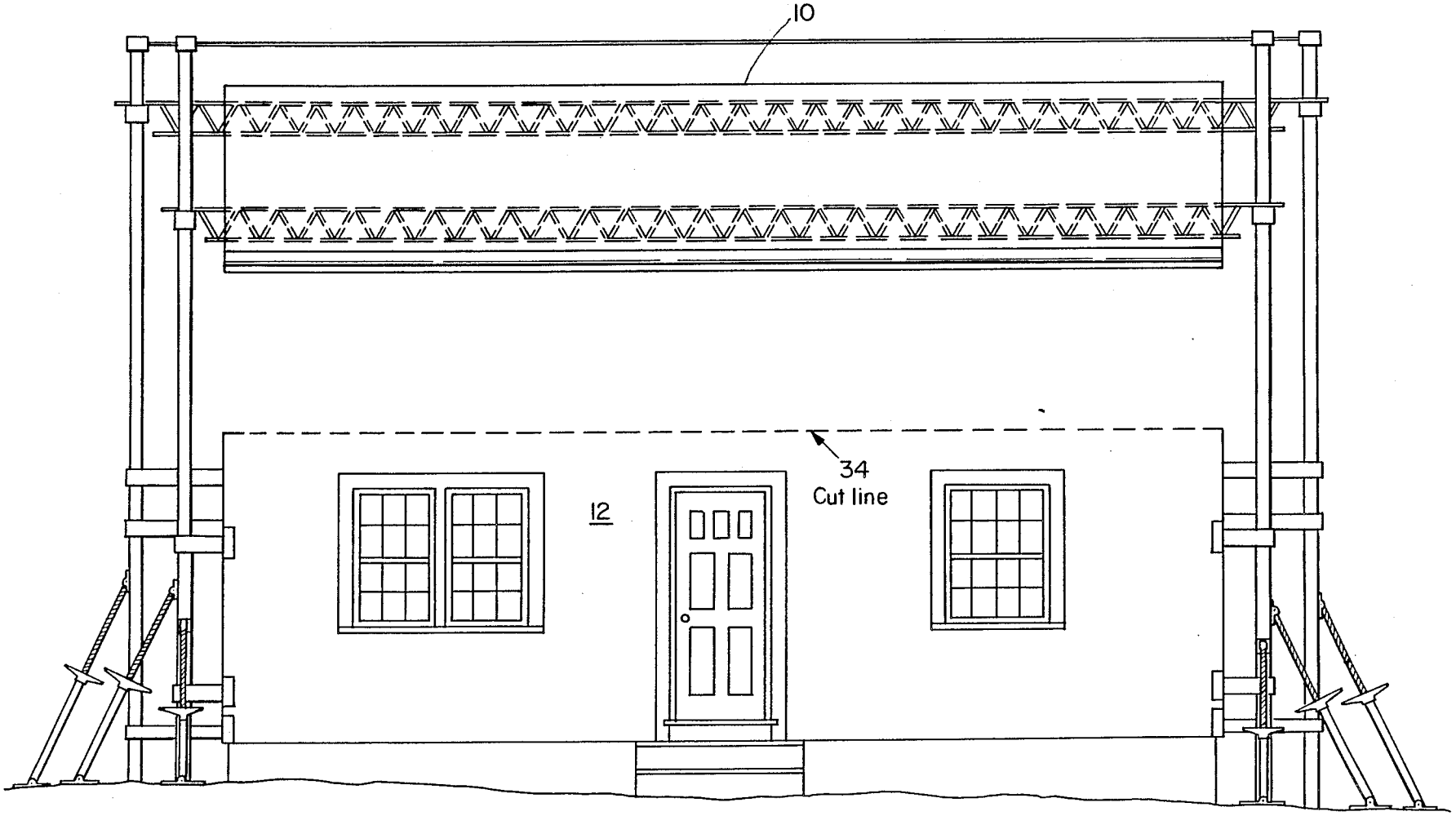
FIG. 4 is a front view of the building of FIG. 1 with the roof raised.

Once roof portion 10 has been detached and severed from existing building 12, lifting force may be applied to the lifting beams to raise the selected roof portion 10. As shown herein, the lifting force is provided by lifting cylinders 48, 48*a*, and 48*b* which provide lifting force to lifting couplings 42, 44, and 48 and lifting beams 20, 22, and 24 in the direction of arrow 50 to raise the roof to a desired height. In another construction, the lifting force may be provided by pulley and cable. The lifting force is controlled by control unit 43 which, via control cables 45, 45*a*, and 45*b*, assures that a uniform lifting force is applied at each lifting tower in the direction of arrow 50. Roof portion 10, FIG. 4, is shown in a side view detached and raised from existing structure 12 to facilitate construction of additional space under the roof.

Figure 5:
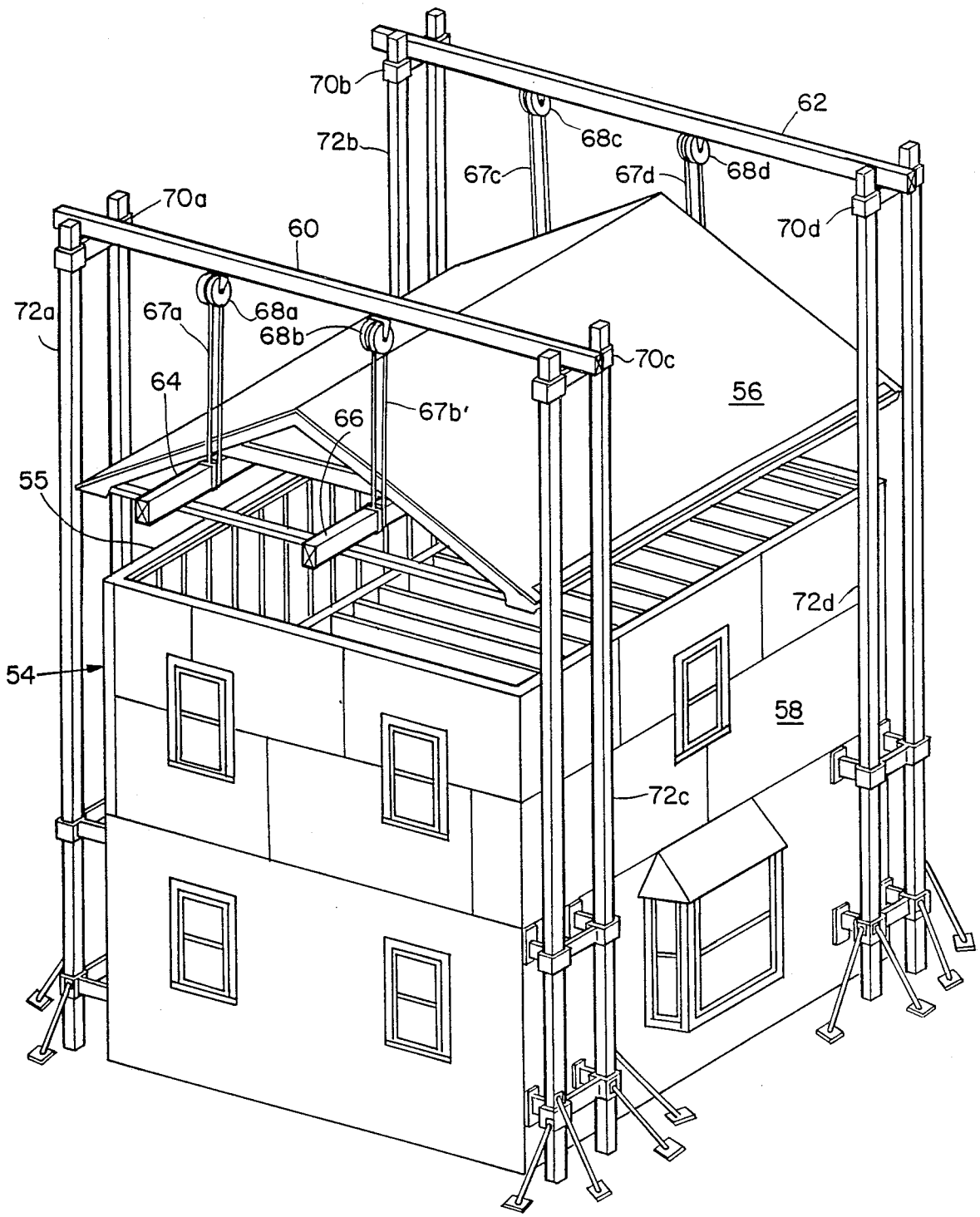
FIG. 5 is a front view of another building with a selected portion of a roof raised and additional space constructed underneath.

In an alternative method of raising a roof, cross-lifting beams 60 and 62, FIG. 5, are provided and arranged transverse to lifting beams 64 and 66. Cross-lifting beams 60 and 62 are placed above roof portion 56 and connect to lifting beams 64 and 66 by way of cables 67*a–d* of hoists 68*a–d*. Cross-lifting beams 60 and 62 are held by lifting couplings 70*a–d* in a fixed position on lifting towers 72*a–d*. Once newly constructed walls 54, 55, and 58 have been constructed, roof portion 56 can be lowered and attached to the newly constructed walls.

Figure 6:
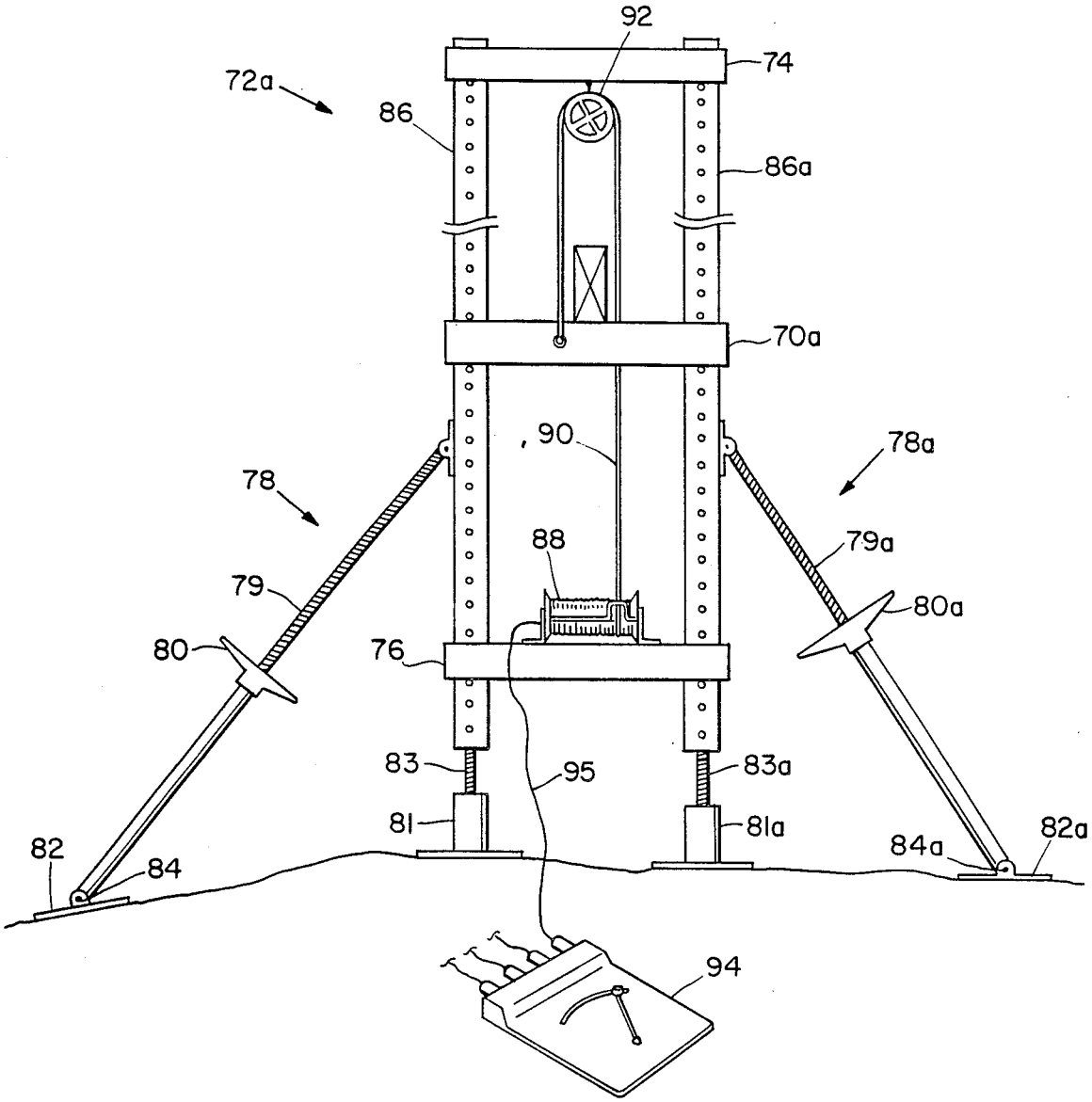
FIG. 6 is a detail of one of the lifting towers shown in FIG. 5.

Lifting tower 72*a*, shown in detail in FIG. 6, includes in one construction lifting coupling 70*a*, top brace 74, bottom brace 76, and stabilizer legs 78 and 78*a*. Stabilizer legs 78 and 78*a* are adjustable to various terrain by way of adjustment handles 80 and 80*a* which turn about upper stabilizer portions 79 and 79*a*, which are threaded. Additionally, stabilizer base supports 82 and 82*a* are provided which adapt to sloping terrain by means of adjustable joint 84 and 84*a*.

Columns 86 and 86*a* may be provided in any length desired or may be provided in sections which interlock together, dependent upon the height of the roof to be raised. Column base supports 81, 81*a* are shown independently adjustable to uneven terrain via threaded rods 83 and 83*a* or may be adjusted simultaneously via a jack stand.

Lifting means is provided by means of hoist 88, cable 90, and pulley 92 controlled by control center 94 and control cable 95, which provide central control for all of the lifting means of the lifting towers to uniformly raise the roof. Hoist 88 may also be located at the top of the tower in the position of pulley 92.

Figure 7:
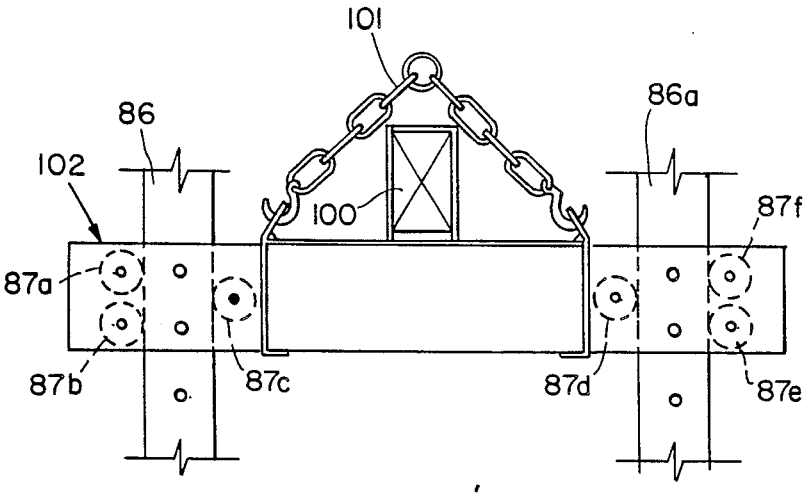
FIG. 7 shows a lifting coupling engaged with a lifting beam.

As detailed in FIG. 7, lifting beam 100 rests on coupling 102 which travels up and down columns 86 and 86*a*. Cylindrical rollers 87 guide coupling 102 up and down the columns and help prevent binding or twisting. Lifting force is applied to the coupling via chain 101 attached to the coupling.

Figure 7A:
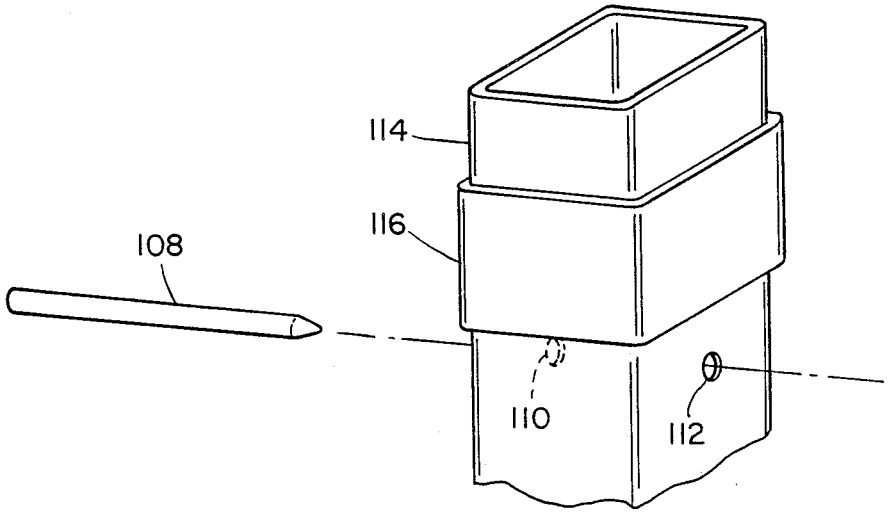
FIG. 7A shows a retaining pin supporting a lifting coupling.

Once the roof portion has been lifted, retaining pin 108, FIG. 7A, may be inserted through holes 110 and 112 which are aligned parallel on opposite faces of column 114 and serve to support coupling 116 and insure that it does not slide down the column.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A method for raising at least a selected portion of an existing peak roof on a building for expansion, comprising;

placing at least two lifting beams parallel to the peak and in general parallel relationship to each other to support the selected portion of the roof;

arranging at least two paris of portable modular lifting towers around the selected roof portion, externally to, and structurally independent of a building and closely spaced to the exterior walls of the building, each pair having one tower disposed along one wall of the building and the other tower disposed along the opposite peripheral wall of the building, said tower extending above the roof portion to be lifted;

stabilizing the lifting towers;

suspending the lifting beams from the lifting towers with respect to the ground below the tops of the towers;

severing the selected roof portion from a building to be expanded;

applying lifting force through the lifting towers to raise the lifting beams and the attached severed roof portion toward the tops of the towers;

installing a floor covering and new walls under the raised roof portion, lowering said selected roof portion and attaching the roof to the new walls to form additional space within the building.

2. The method of claim 1 in which the placing of at least two lifting beams includes attaching a plurality of cross-support members between the roof rafters perpendicular to said lifting beams.

3. The method of claim 1 in which the placing of at least two lifting beams includes connecting the lifting beams to the plurality of cross-support members.

4. The method of claim 1 in which the stabilizing of the towers includes bracing together the towers at their upper ends to maintain their vertical alignment during lifting.

5. The method of claim 1 in which the stabilizing of the towers includes erecting at least two side stabilizers proximate to lower ends of each tower and extending against the ground.

6. The method of claim 5 in which the erecting of the side stabilizers includes adjusting each stabilizer individually to match variation in the grade.

7. The method of claim 5 in which the erecting of the side stabilizers includes deploying a hinged foot at the distal end of each stabilizer to accommodate local discontinuities in the grade.

8. The method of claim 1 in which the stabilizing of the towers includes adjusting the vertical height of the towers to set the tower pair in vertical alignment.

9. The method of claim 1 in which the suspending of the lifting beams includes interconnecting lifting beams and lifting towers with a lifting coupler.

10. The method of claim 1 in which the suspending of the lifting beams includes providing perforated hole pairs along the length of the towers to accept the placement of safety pins to prevent downward movement of a lifting coupler.

11. The method of claim 1 in which the severing of the selected roof portion includes separating the roof portion from the ceiling joists of the lower level to provide the ceiling joists to be used as the floor joists for the upper level.

12. The method of claim 11 in which the severing of the selected roof portion includes detaching the entire selected roof structure inclusive of any over hanging roof portion such as facia and gutter.

13. The method of claim 1 in which applying lifting force through the lifting towers includes lifting at a uniformly controlled pace to ensure a level ascension of the selected roof portion.

14. The method of claim 1 in which applying lifting force through the lifting towers includes pulling the severed roof portion upwards from a position on the tower above the roof.

* * * * *